US006155235A

United States Patent [19]

Kilgore

[11] Patent Number: 6,155,235

[45] Date of Patent: Dec. 5, 2000

[54] PRESSURE PULSATION DAMPER WITH INTEGRATED HOT SOAK PRESSURE CONTROL VALVE

[75] Inventor: Jason T. Kilgore, Newport News, Va.

[73] Assignee: Siemens Automotive Corporation, Auburn Hills, Mich.

[21] Appl. No.: 09/312,190

[22] Filed: May 14, 1999

[51] Int. Cl.[7] ..... F02M 37/04

[52] U.S. Cl. ..... 123/467; 123/511

[58] Field of Search ..... 123/467, 456, 123/510, 511, 514

[56] References Cited

U.S. PATENT DOCUMENTS 5,458,104 10/1995 Tuckey ..... 123/467

5,579,739 12/1996 Tuckey et al. ..... 123/467

5,605,133 2/1997 Tuckey ..... 123/511

*Primary Examiner*—Thomas N. Moulis

[57] ABSTRACT

The integrated pressure pulsation damper and hot soak pressure valve lies normally open adjacent the fuel rail and damps fuel pressure pulsations during engine operation caused by opening and closing of the fuel injectors. When the engine is turned off, and a hot soak condition occurs, the valve automatically closes to retain a high fuel pressure in the fuel rail to facilitate hot restarts. Upon restarting the engine, the valve reverts to its normally open condition, serving as a pressure pulsation damper.

6 Claims, 3 Drawing Sheets

PRESSURE PULSATION DAMPER WITH INTEGRATED HOT SOAK PRESSURE CONTROL VALVE

TECHNICAL FIELD

The present invention relates to a fuel system for supplying fuel at a regulated pressure to an automotive engine and particularly relates to an integrated pressure pulsation damper and hot soak pressure control valve for absorbing fuel pressure pulsations during normal engine operating conditions and closing the valve during a hot soak condition to enable quick engine restart.

BACKGROUND

Conventional non-return type fuel systems for automotive engines typically mount a fuel pressure regulator in the fuel tank. A pressure pulsation damping device is often located in the fuel line adjacent the fuel rail. A system of this type, however, can experience hot start and restart problems due to vapor lock. That is, when the engine is turned off and temperatures within the fuel rail are elevated, the fuel pressure in the fuel rail is checked by the regulator in the fuel tank. This pressure check is intended to be sufficiently high that fuel will not vaporize in the fuel rail and immediate hot restart of the engine is possible. However, if the pressure is not checked sufficiently high enough, restart or vapor lock problems occur.

DISCLOSURE OF THE INVENTION

In accordance with the present invention, a conventional fuel regulator is typically disposed within a fuel tank and provides fuel to a fuel rail at a regulated pressure. The fuel, however, is supplied through a normally open integrated pressure pulsation damper and hot soak pressure control valve. The control valve includes a diaphragm which is responsive to pressure pulsations in the fuel, e.g., as a result of the opening and closing of the fuel injectors in the fuel rail, to absorb or dampen the pressure pulses in the fuel system. The control valve serves no other purpose during normal operating conditions than as a pressure pulsation damper. However, when the engine is turned off and a hot soak condition occurs, the valve automatically closes to maintain a high pressure in the fuel rail. The fuel rail is therefore isolated from the balance of the fuel system to maintain the higher pressure and prevent fuel vaporization. That is, the control valve closes to check the pressure in the rail to a predetermined pressure higher than the normal operating pressure. Accordingly, when the engine is restarted, fuel under high pressure in liquid form is available in the fuel rail for delivery to the fuel injectors. Consequently, the present integrated control valve for pulsation damping and hot soak pressure control may replace existing pulsation dampers in most fuel systems, while avoiding recalibration of the engine or modifications to the conventional fuel pumps and pressure regulators. The system hereof, however, would result in quick hot start and restarts without vapor lock problems.

In a preferred embodiment according to the present invention, there is provided a fuel system for an engine comprising a plurality of fuel injectors, a fuel rail for supplying fuel to said injectors, a fuel tank, a fuel pump for pumping fuel from the fuel tank to the fuel rail, a pressure regulator for supplying fuel at a regulated pressure to the fuel rail and a normally open integrated pressure pulsation damper and hot soak pressure control valve between the pressure regulator and the fuel rail, the valve having a spring-biased diaphragm operable to damp fuel pressure pulsations in the fuel system and to close the control valve in response to an increase in pressure in the fuel rail above the regulated pressure.

In a further preferred embodiment according to the present invention, there is provided a method of operating a fuel system for an engine wherein the fuel system includes a fuel tank, a fuel rail in communication with a plurality of fuel injectors, a fuel pump and a pressure regulator, comprising the steps of pumping fuel from the fuel tank to the fuel rail, regulating the pressure of the fuel pumped to the fuel rail, providing an integrated pressure pulsation damper and hot soak pressure control valve between the pressure regulator and the fuel rail, damping fuel pressure pulsations in the fuel system using the integrated pressure pulsation damper and hot soak control valve and closing the control valve in response to an increase in pressure in the fuel rail.

BEST MODE FOR CARRYING OUT THE INVENTION

Figure 1:
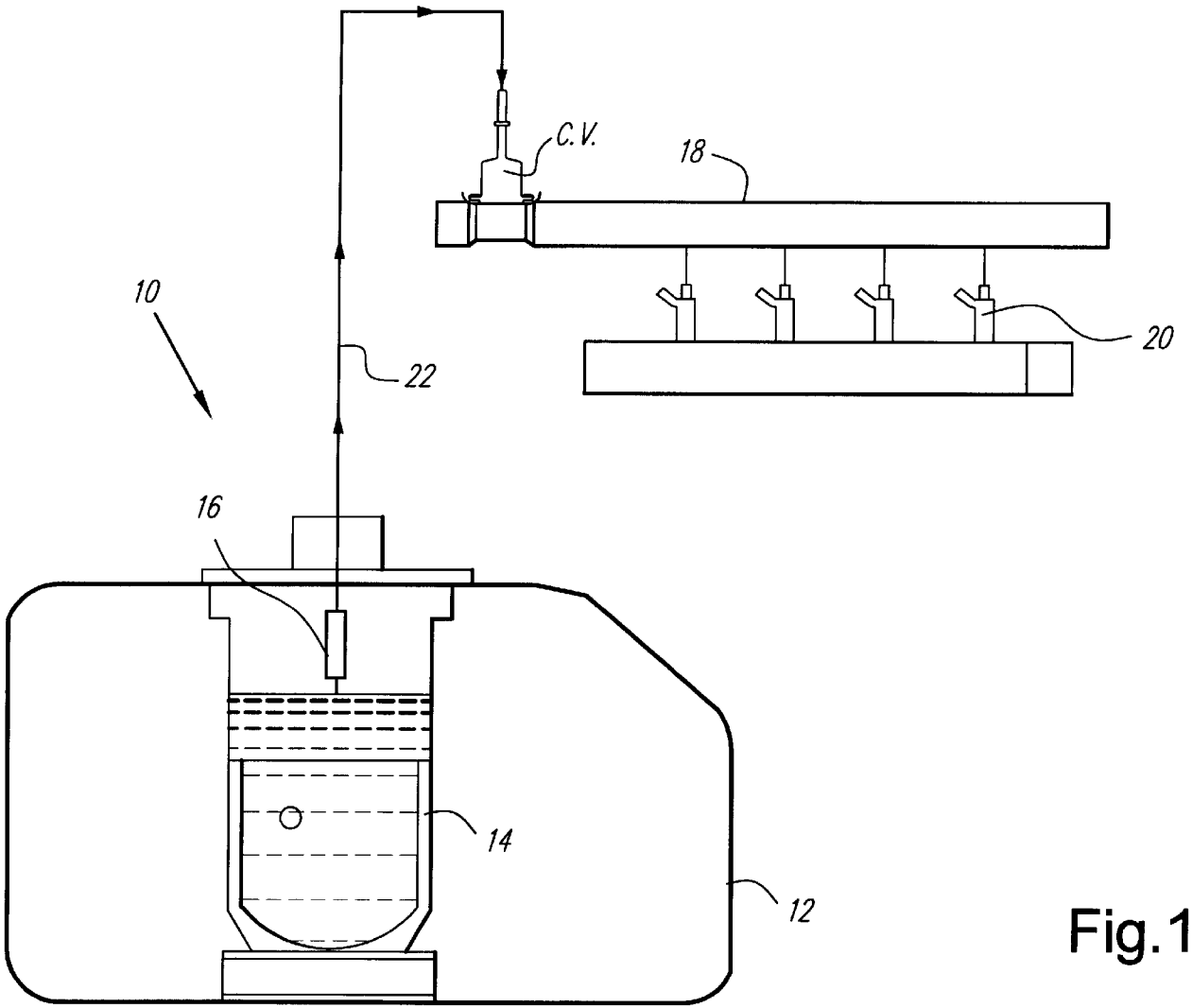
FIG. 1 is a schematic illustration of a fuel system incorporating a pressure pulsation damper with integrated hot soak pressure relief control valve.

Referring to FIG. 1, there is illustrated a fuel system for an automotive engine, generally designated 10, and comprising a fuel tank 12 containing a fuel pump 14 and a pressure regulator 16 within the fuel tank for regulating the pressure of the fuel supplied from pump 14 through regulator 16 to a predetermined pressure for supply to the fuel rail 18. As illustrated, a plurality of fuel injectors 20 are in communication with the fuel rail. Consequently, fuel at a regulated pressure is supplied the fuel rail for flow into the engine by way of the injectors.

An integrated pressure pulsation damper and hot soak pressure control valve, generally designated C.V., is provided in the fuel line 22 between the pressure regulator 16 and the fuel rail 18. In a preferred embodiment illustrated in FIG. 2, the control valve comprises an upper, generally inverted cup-shaped housing section 24 having a fuel inlet 26 for connection to a fuel line 22 and a lower, generally cup-shaped housing 28 having a plurality of apertures 30 circumferentially spaced one from the other for supplying fuel from the inlet through the valve into the fuel rail 18. The upper and lower sections are joined one to the other with a diaphragm 32 disposed therebetween. The valve is mounted in a mounting cup 34 formed on the fuel rail 18.

The diaphragm 32 has a central aperture 36 receiving a portion of a valve member 38. An annular part 39 lies on the opposite side of diaphragm 32 from a shoulder on valve member 38 wherein the diaphragm is clamped to the valve member 38. The valve member 38 includes a central opening 40. The lower cup-shaped section 28 fixedly mounts a valve abutment 41 having a post 42 projecting through the opening 40 of the valve member 38. Valve abutment 41 includes a passageway in communication with opening 40 and apertures 30 in housing 28. The valve member 38 includes a sleeve 44 which projects away from diaphragm 32 and surrounds a valve element 46, for example, a spherical ball valve. The valve element 46 is movable toward and away from a valve seat 48 formed on the valve member 38 about opening 40. The valve element 46 is biased toward a valve-closed position by a spring 50 having opposite ends bearing against the valve element 46 and the base of a housing 52. The housing 52 is fixed in the upper cup-shaped housing section 24 and includes a passageway 53 for fuel to flow within housing 52 and about valve element 46.

In operation, the fuel is supplied to the control valve via inlet 26 under a regulated pressure. The fuel pressure on opposite sides of the diaphragm 32 maintains the diaphragm in a balanced position with member 38 normally spaced from abutment 41 with post 42 maintaining valve element 46 spaced from seat 48. Pressure pulsations are damped by movement of the diaphragm in response thereto with post 42 at all normal engine operating conditions maintaining element 46 off seat 48 and hence maintaining the valve in a normally open condition. Particularly, with lower than normal fuel pressure on the outlet side of diaphragm 32, diaphragm 32 moves member 38 toward the valve abutment 41. By displacing the valve member 38 toward abutment 41, post 42 displaces the valve element 46 further away from seat 48, causing the valve to open to a further extent. With higher than normal fuel pressure on the outlet side of the diaphragm 32, diaphragm 32 moves member 38 away from abutment 41, effectively reducing the valve opening between valve element 46 and the valve seat 48. The movement of the diaphragm 32 thus dampens pressure pulsations while maintaining the valve normally open under normal engine operating conditions.

When the engine stops and a hot soak condition develops in the fuel rail, the higher developed pressure in the fuel rail causes the diaphragm 32 to be displaced away from the abutment 41, causing the valve seat 48 to engage the ball 46, closing the valve opening. Consequently, fuel at a higher pressure is maintained in the fuel rail when the control valve closes, enabling a hot start or restart. Upon a decrease in pressure in the fuel rail after starting, the diaphragm 32 is displaced toward the abutment 41 whereby the post 42 engages the ball valve 46 to open the valve whereby the integrated valve serves once again as a pulsation damper during normal engine operation.

Figure 3:
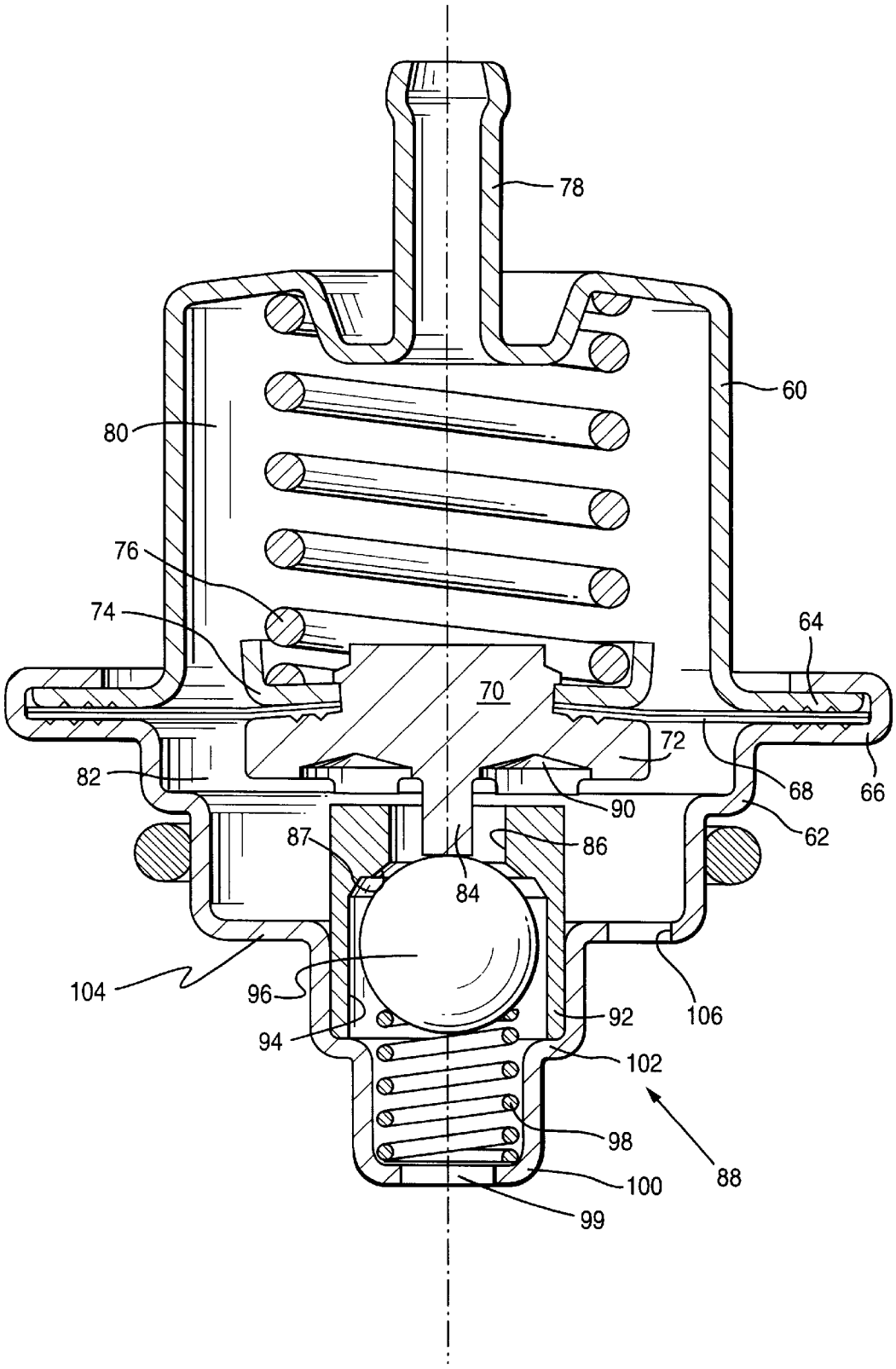
FIG. 3 is a view similar to FIG. 2 illustrating a further form of a pressure pulsation damper and integrated hot soak pressure relief control valve.

Another form of integrated pressure pulsation damper and hot soak pressure control valve may be provided in the fuel line 22 between pressure regulator 16 and the fuel rod 18. This valve may be similar to the valve disclosed in prior U.S. Pat. No. 5,413,077 of common assignee herewith. Referring to FIG. 3 hereof, the control valve of a second embodiment hereof may comprise a generally cylindrical housing having an upper, generally inverted cup-shaped housing part 60 and a stepped lower housing part 62 joined and sealed to one another with confronting margins 64 and 66, respectively. The margins 64 and 66 also clamp between them the outer margin of a diaphragm 68 mounting a central flange or part 70. Part 70 includes a lower annular rim 72 underlying an inner margin of diaphragm 68. An upper, generally cup-shaped flange 74 is secured to an upper end portion of part 70 and receives the lower end of a helical coil spring 76. The upper end of spring 76 bears against the upper end of upper housing part 60 and surrounds a nipple 78 open to the atmosphere. Consequently, spring 76 resides in an upper chamber 80, while the diaphragm 68 defines in part a lower chamber 82.

Part 70 includes a central, generally axially extending projection 84 which extends downwardly into an opening 86 forming part of a normally open valve assembly, generally designated 88, and described hereinafter. The underside of part 70 includes a pair of cylindrical recesses 90 having centers lying on a common diameter. The recesses 90, as illustrated in FIG. 3, in part overlie the opening 86 of the valve assembly 88 and in part open into chamber 82.

The valve assembly 88 includes a cylindrical valve body 92 which comprises the valve opening 86 at an upper end thereof surrounded by valve seat 87 and an enlarged cylindrical passage 94 in which a valve element 96, for example, a ball, is disposed. As illustrated, ball 98 is free-floating in passage 94, i.e., it is spaced a substantial distance from the side walls of the valve body 92. Valve element 96 rests on an underlying coil spring 98. The lower end of the coil spring 98 bears on an in-turned flange 100 forming the lower terminus of the lower housing part 68. The coil spring 98 biases the ball upwardly and it will be appreciated that it engages the tip of the downward projection 84 of part 70, as illustrated. The lower terminus of lower housing part 62 includes an opening 99 defining a fuel inlet port for the regulator.

The lower housing part 62 includes a number of reduced diameter steps toward its lower in-turned flange 100. The step 102 forms a seat for the lower end of the valve body 92. In an annular surface 104 extending about valve body 92 and forming the next step above step 102, there is provided a plurality of circumferentially spaced openings 106 for flowing fuel from chamber 82.

Figure 2:
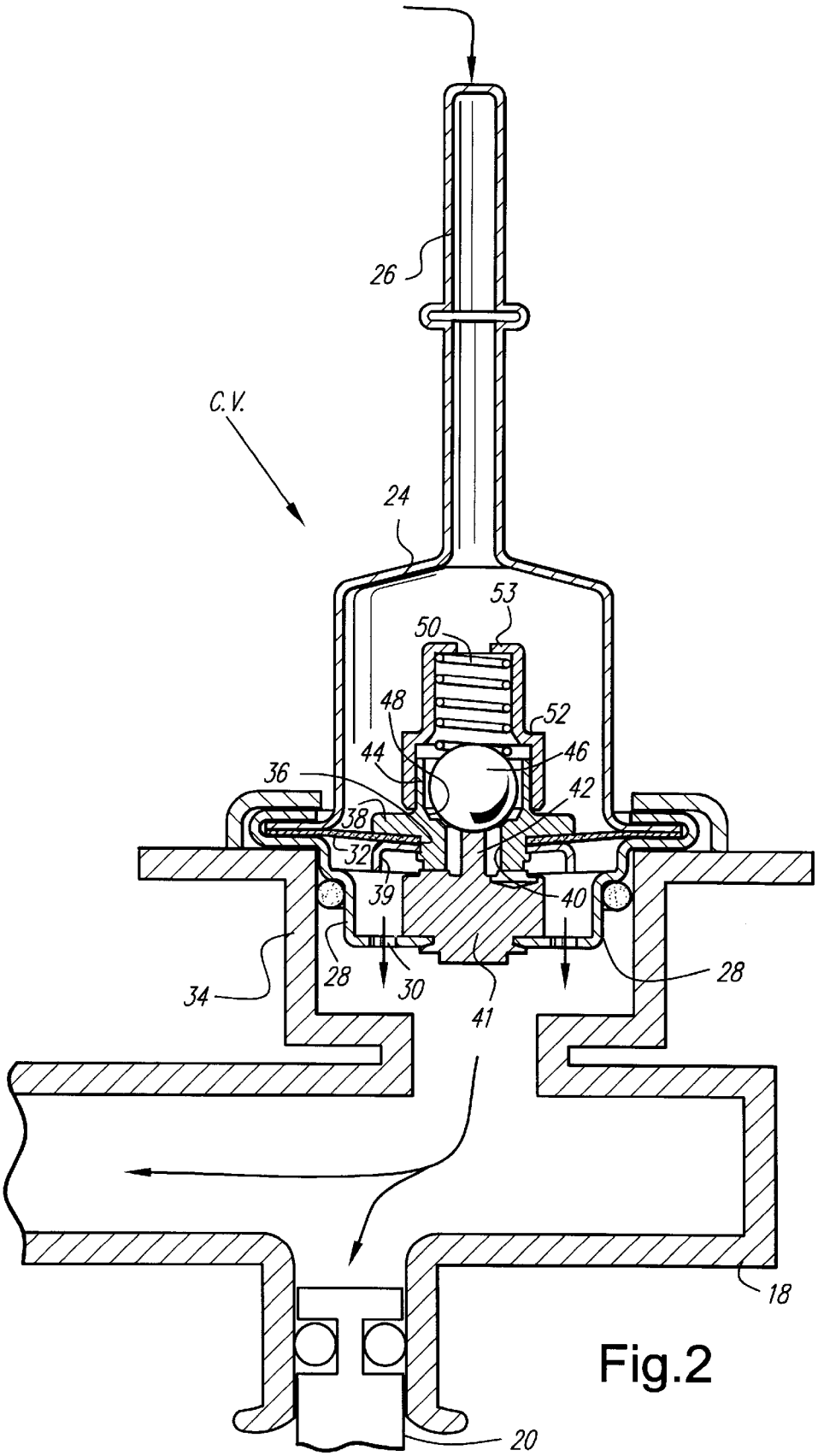
FIG. 2 is a fragmentary enlarged cross-sectional view with parts in cross-section of a pressure pulsation damper with integrated hot soak pressure relief control valve disposed in the fuel system of FIG. 1.

The operation of the control valve illustrated in FIG. 3 is similar to the operation of the control valve illustrated in FIG. 2. In FIG. 3, however, fuel is supplied under a regulated pressure from the fuel tank to the control valve via passage 94. The valve is normally open and fuel flows through passage 94 past the valve element 96 and seat 87 into the chamber 82 via recesses 90 for flow into the fuel rail through openings 106. The pressures on the opposite sides of the diaphragm 68 maintain the valve in a normally open position and pressure pulsations are damped by movement of the diaphragm with attached post 84 toward and away from the control element 96. Hence, the pressure pulsations are damped while maintaining the valve in a normally open position.

When a hot soak condition develops, the higher pressure in the fuel rail causes diaphragm 68 to move away from valve element 96, closing the element 96 under the bias of spring 98 against the valve seat 87. Consequently, fuel at a higher pressure is maintained in the fuel rail when the control valve closes, enabling hot start or restart. As in the prior embodiment, upon a decrease in pressure in the fuel rail after starting, the diaphragm 68 is displaced under the reduced fuel rail pressure toward the valve element 96, opening the valve whereby the integrated valve serves once again as a pulsation damper during normal engine operation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel system for an engine comprising:

a plurality of fuel injectors;

a fuel rail for supplying fuel to said injectors;

a fuel tank;

a fuel pump for pumping fuel from the fuel tank to the fuel rail;

a pressure regulator for supplying fuel at a regulated pressure to said fuel rail; and a normally open integrated pressure pulsation damper and hot soak pressure control valve between said pressure regulator and said fuel rail, said valve having a spring-biased diaphragm operable to damp fuel pressure pulsations in said fuel system and to close said control valve in response to an increase in pressure in said fuel rail above said regulated pressure.

2. A fuel system according to claim 1 wherein said control valve includes a diaphragm carrying a valve member having an opening, a valve element, a spring for biasing said valve element toward said valve member to close said opening and a post for engaging said valve element to maintain said valve open during operation of the engine, enabling the valve element to close the valve opening in response to a pressure in the fuel rail higher than the regulated pressure and movement of said diaphragm away from said post.

3. A fuel system according to claim 2 wherein said valve member includes a valve seat surrounding said opening, a housing for said spring enabling said spring to bias said valve element toward said seat, said diaphragm and said valve member carried thereby being movable away from said abutment member in response to a pressure in said fuel rail higher than the regulated pressure enabling said valve element to engage said valve seat closing said valve opening.

4. A method of operating a fuel system for an engine wherein the fuel system includes a fuel tank, a fuel rail in communication with a plurality of fuel injectors, a fuel pump and a pressure regulator, comprising the steps of:

pumping fuel from said fuel tank to said fuel rail;

regulating the pressure of the fuel pumped to said fuel rail;

providing an integrated pressure pulsation damper and hot soak pressure control valve between said pressure regulator and said fuel rail;

damping fuel pressure pulsations in said fuel system using said integrated pressure pulsation damper and hot soak control valve; and closing said control valve in response to an increase in pressure in said fuel rail.

5. A method according to claim 4 including maintaining said Is integrated pressure pulsation damper and hot soak control valve open during engine operation.

6. A method according to claim 4 wherein said integrated pressure pulsation damper and hot soak control valve includes a diaphragm dividing said valve into first and second chambers in respective communication with said fuel rail and said fuel pump, and including the step of displacing a valve member carried by said diaphragm toward said second chamber in response to an increase in pressure in said fuel rail in an engine-off condition to close said valve thereby isolating said chambers from one another.

* * * * *